US009114944B2

(12) United States Patent
Kanzawa

(10) Patent No.: US 9,114,944 B2
(45) Date of Patent: Aug. 25, 2015

(54) SHEET SUPPLY DEVICE AND IMAGE FORMING APPARATUS

(71) Applicant: Oki Data Corporation, Tokyo (JP)

(72) Inventor: Naoki Kanzawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/491,087

(22) Filed: Sep. 19, 2014

(65) Prior Publication Data

US 2015/0084263 A1 Mar. 26, 2015

(30) Foreign Application Priority Data

Sep. 20, 2013 (JP) ..... 2013-195446

(51) Int. Cl.

| | |
|---|---|
| ***B65H 3/52*** | (2006.01) |
| ***B65H 3/06*** | (2006.01) |
| ***G03G 15/00*** | (2006.01) |
| ***B65H 1/04*** | (2006.01) |
| ***B65H 5/06*** | (2006.01) |

(52) U.S. Cl.

CPC ..... *B65H 3/0676* (2013.01); *B65H 1/04* (2013.01); *B65H 3/5223* (2013.01); *B65H 5/068* (2013.01); *G03G 15/6529* (2013.01)

(58) Field of Classification Search

CPC ..... B65H 3/52; B65H 3/5223; B65H 2405/1118; B65H 2405/142; B65H 3/02

USPC ..... 271/121

See application file for complete search history.

(56) References Cited

U.S. PATENT DOCUMENTS 6,478,294 B2 * 11/2002 Hiratani ..... 271/10.09
2007/0052156 A1 * 3/2007 Lee et al. ..... 271/160

FOREIGN PATENT DOCUMENTS

JP 2011-201692 A 10/2011

* cited by examiner

*Primary Examiner* — Michael McCullough
(74) *Attorney, Agent, or Firm* — Muncy, Geissler, Olds & Lowe, P.C.

(57) ABSTRACT

A sheet supply device includes a medium loading part that includes a medium loading surface on which medium is loaded; and a medium supply part that is arranged facing the medium lading surface, and sandwiches the medium with the medium loading part applying a pressure to the medium, and sends the medium loaded in the medium loading part in a predetermined carrying direction. The medium loading part includes a first friction member arranged in a position facing the medium supply part so that the first friction member contacts the medium supply part when there is no medium on the medium loading part, and a second friction member arranged on an upstream side of the first friction member in the carrying direction, and a friction coefficient (μd) between the second friction member and the medium is larger than a friction coefficient (μc) between the first friction member and the medium.

19 Claims, 5 Drawing Sheets

5
14
60
60d
60a
60b
33a
31
32
Fa
Fb
12b
Fd
33
12

SHEET SUPPLY DEVICE AND IMAGE FORMING APPARATUS

CROSS REFERENCE APPLICATION

The present application is related to, claims priorities from and incorporates by reference Japanese Patent Application No. 2013-195446 filed on Sep. 20, 2013.

TECHNICAL FIELD

The present invention relates to a sheet supply device and an image forming apparatus adopting the sheet supply device.

BACKGROUND

Conventionally, this type of device has a configuration that a friction member whose friction is higher than an inter-sheet friction is arranged on an opposing surface to a supply roller on a stacking pallet to get a sheet pressed and contacted against the supply roller such that sheets on the stacking pallet is supplied one by one from a sheet located on the top in order as a separation part in a case where remaining of sheets stacked on the stacking pallet is small (see Japanese Laid-Open Patent Application No. 2011-201692, page 10, FIG. 8).

However, with the configuration of the conventional device, sheets are accurately supplied one by one. As a result, when a medium such as an envelope that has a pocket-like structure made of two sheets of paper is supplied, a problem may occur. In other words, when an envelope located on the bottom of a pile of stacked envelopes is supplied, a bottom side sheet of the envelope that contacts the friction member and a top side sheet thereof that contacts the supply roller are separated, and then the top and bottom side sheets are supplied as it makes a difference in carried amounts of the sheets in a supply traveling direction. However, because ends of the top and bottom side sheets are connected, a front end and a rear end in the direction are distorted due to the difference in the carried amounts in the traveling direction. Therefore, when distortion of the envelope is increased as the envelope is carried, the distorted ends may contact and give pressure on a sheet running guide therearound and may be got into a carrying roller on a downstream side. Then, a transferring ability may be deteriorated and paper jamming and skew may occur.

A sheet supply device disclosed in the application includes a medium loading part that includes a medium loading surface on which medium is loaded; and a medium supply part that is arranged facing the medium lading surface, and sandwiches the medium with the medium loading part applying a pressure to the medium, and sends the medium loaded in the medium loading part in a predetermined carrying direction. The medium loading part includes a first friction member that is arranged in a position facing the medium supply part so that the first friction member contacts the medium supply part when there is no medium on the medium loading part, and a second friction member that is arranged on an upstream side of the first friction member in the carrying direction, and a friction coefficient (μd) between the second friction member and the medium is larger than a friction coefficient (μc) between the first friction member and the medium.

According to the present invention, distortion when envelopes are supplied is kept to a minimum, so that occurrence of paper jamming and skew during carriage is suppressed.

DETAILED DESCRIPTION OF EMBODIMENTS

First Embodiment

Figure 1:
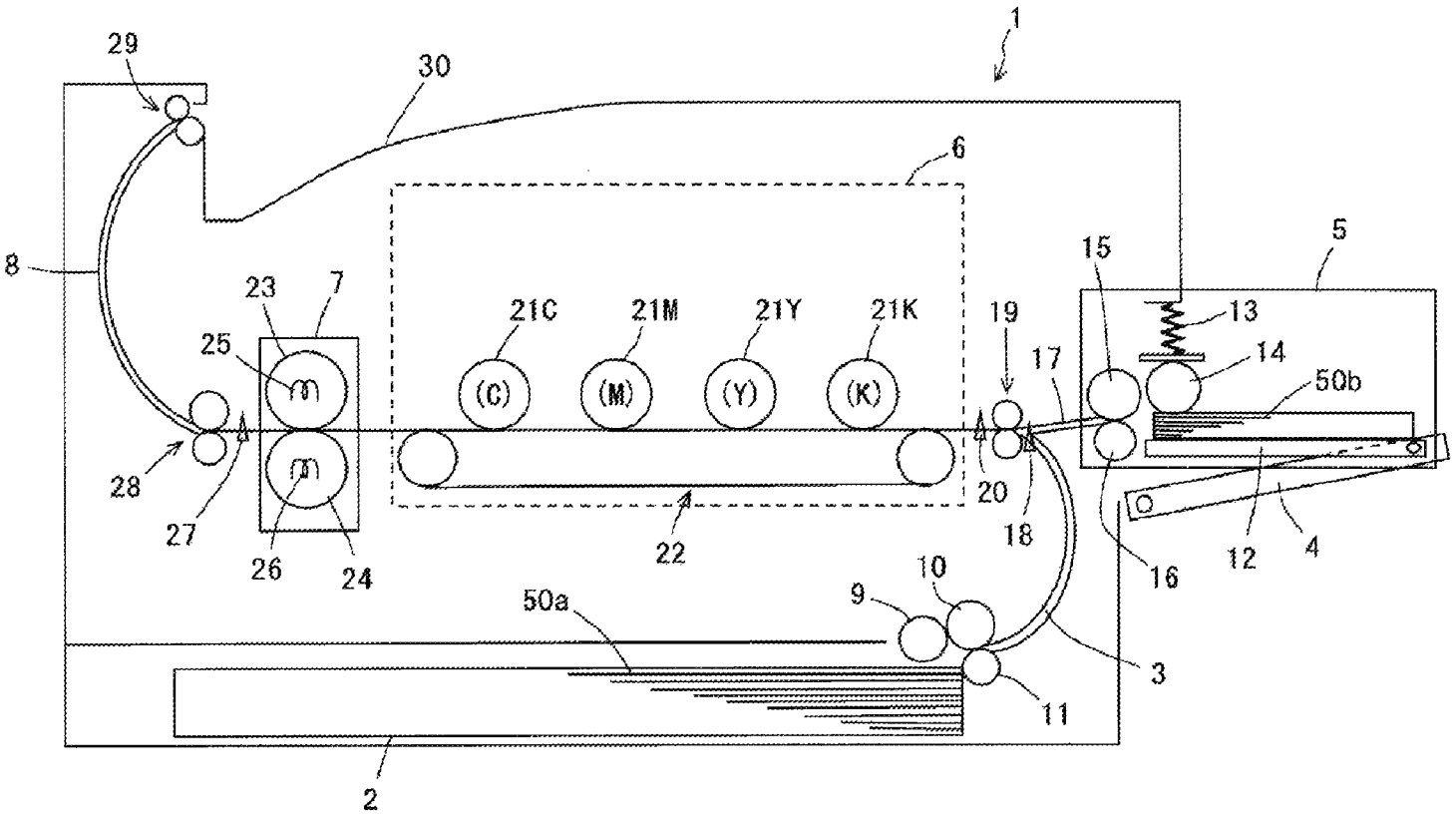
FIG. 1 is a main body configuration view that briefly shows a main part configuration of a printer according to a first embodiment of the present invention.

FIG. 1 is a main body configuration view that briefly shows a main part configuration of a printer according to a first embodiment which includes a sheet supply device of the present invention.

As illustrated in FIG. 1, a printer 1 as an image forming apparatus has a configuration as a color electrographic printer, and is provided with a medium cassette 2, a sheet supply carrying path 3, a medium tray 4, a sheet supply part 5, an image forming part 6, a fuser part 7, and an ejection carrying path 8. The medium cassette 2 contains a recording sheet 50*a*, and the recording sheet 50*a* is contacted and pressed to a feeding roller 9 by a pressure method (not illustrated). On a downstream side of the feeding roller 9 in a sheet carrying direction, a carrying roller 10 and a separation roller 11 are arranged, and one sheet is separated from the recording sheet 50*a* fed by the feeding roller 9 and then carried to the sheet supply carrying path 3.

The medium tray 4 is for supplying a long medium, thin medium, thick medium, narrow medium, and envelope that are not compatible with the medium cassette 2, and is provided in a storable and foldable manner with respect to a print 1 main body. In the medium tray 4, a loading pallet 12 on which a recording sheet 50*b* as a medium is loaded is swingably provided. Hereinafter, when there is no need to distinguish the recording sheets 50*a* and 50*b*, the recording sheets 50*a* and 50*b* may be described as recording sheet 50.

The sheet supply part 5 as a sheet supply device includes the loading pallet 12 as a medium mounting part, a sheet supply roller 14 as a medium supply part, a carrying roller 15 as a medium carrying part, and a separation roller 16, and the recording sheet 50*b* loaded on the staking pallet 12 is supplied to the image forming part 6. The sheet supply roller 14 is biased to contact and press the recording sheet 50 by a pressure spring 13. The sheet supply part 5 is explained in detail later.

In connection with the sheet supply part 5, a carrying path 17 to the image forming part 6 is formed. The sheet supply carrying path 3 is merged into the carrying path 17, and a sheet supply detection sensor 18, a carrying roller pair 19, and a writing timing sensor 20 are arranged on in the carrying path 17. The image forming part 6 is provided with photosensitive drums 21K, 21Y, 21M, and 21C (may be described as a photosensitive drum 21 when no distinction is needed), a transfer belt unit 22, and so on, and forms image on the recording sheet 50 in an electrographic process. The photosensitive drums 21K, 21Y, 21M, and 21C are for forming color image by overlapping color image of black (K), yellow (Y), magenta (M), and cyan (C) on the recording sheet 50, and correspond to black (K), yellow (Y), magenta (M), and cyan (C).

The carrying roller pair 19 starts carriage at a predetermined timing after the sheet supply detection sensor 18 detects the recording sheet 50 passing through, and then corrects skew of the recording sheet 50 and sends the sheet out to the image forming part 6. The image forming part 6 starts the electrographic process as synchronizing with a timing when the recording sheet 50 passes through the writing timing sensor 20, and then forms toner image on a recording surface of the recording sheet 50 and sends the sheet out to the fuser part 7.

The fuser part 7 is configured with a pair of rollers 23 and 24 that are contacted and pressed to each other with a predetermined pressure. The respective rollers 23 and 24 incorporate heaters 25 and 26 for heating. The ejection carrying path 8 in connection with the fuser part 7 is provided with a carrying detection sensor 27, a carrying roller pair 28, and an ejection roller pair 29. The carrying detection sensor 27 detects a passage of the recording sheet 50 on which toner image is fused in the fuser part 7, and then the carrying roller pair 28 and the ejection roller pair 29 carry the fused recording sheet 50 along the ejection carrying path 8 and eject the sheet to the stacker part 30.

Figure 2:
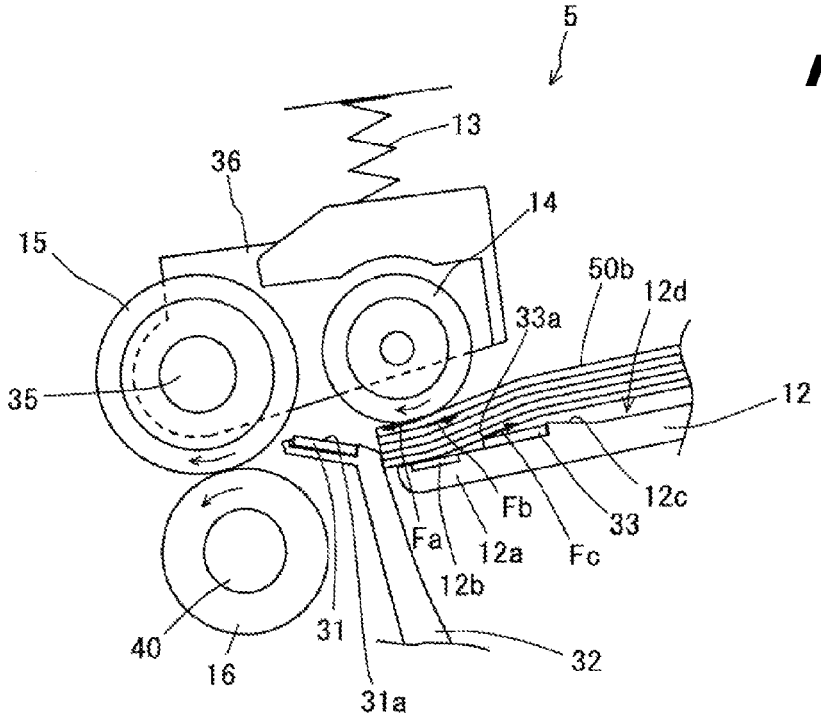
FIG. 2 is a main part configuration view that shows a configuration of a sheet supply part according to the first embodiment of the present invention.
Figure 3:
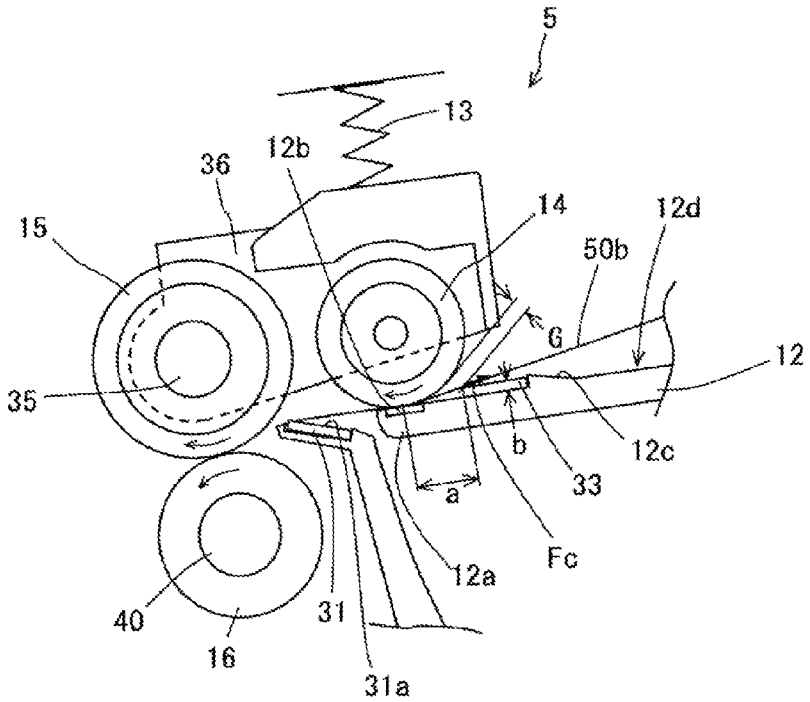
FIG. 3 is a movement explanatory view for explaining movements of the sheet supply part.
Figure 4:
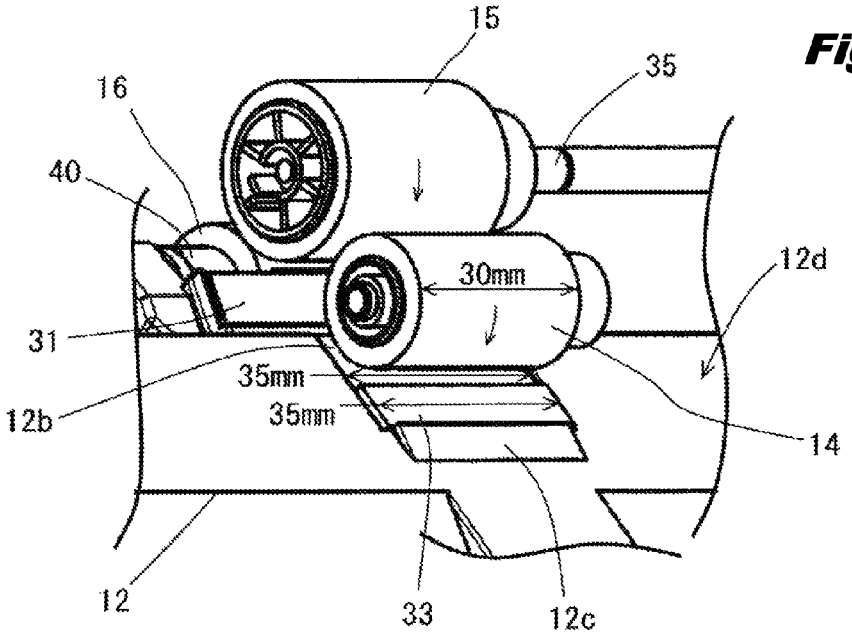
FIG. 4 is a perspective view of the sheet supply part viewed in an oblique direction.

FIG. 2 is a main part configuration view that shows a configuration of the sheet supply part 5. FIG. 3 is a movement explanatory view for explaining movements of the sheet supply part 5. FIG. 4 is a perspective view of the sheet supply part viewed in an oblique direction. Note, for simplicity, a supply roller holder 36, which will be described later, is omitted in FIG. 4.

In the figures, the carrying roller 15 is rotatably held by a rotation shaft 35 to the printer 1 main body. The supply roller holder 36 is rotatably held by the rotation shaft 35, which is the same shaft for the carrying roller 15, and rotatably holds the supply roller 14 such that a shaft for the supply roller 14 is located in parallel with the shaft for the carrying roller 15. The supply roller 14 and the carrying roller 15 are driven and rotated at a predetermined timing in arrow directions in the figures by a driving method (not illustrated).

The separation roller 16 that configures a third separation part together with the carrying roller 15 is arranged to contact the carrying roller 15 with predetermined pressure force such that the shafts for both of the rollers are in parallel, and is held via a torque limiter 40 to the printer 1 main body. Therefore, the separation roller 16 is rotated in the arrow direction in the drawing together with and along with the rotation of the carrying roller 15, and when being rotated together with the carrying roller 15, the separation roller 16 is accompanied by predetermined rotation load caused by the torque limiter 40.

The loading pallet 12 on which the recording sheet 50*b* is loaded is arranged such that a front end part 12*a* thereof opposes the supply roller 14 as illustrated in FIG. 2 so that the loading pallet 12 is able to sandwich a downstream side end part in the carrying direction (may be simply described as downstream side) of the mounted recording sheet 50*b* with the supply roller 14. Herein, the supply roller holder 36 is biased by the pressure spring 13 in a direction that the held supply roller 14 is oriented toward the loading pallet 12, and the loading pallet 12 is adjusted to get positioned in a direction that the front end part 12*a* separates from the supply roller 14 according to an amount (thickness) of the loaded recording sheet 50*b*.

In other words, in the loading pallet 12, as illustrated in FIG. 1, an upstream side end part (hereinafter, may be simply described as an upperstream side) of the recording sheet 50*b* in the carrying direction is rotatably held by the medium tray 4. A position of the front end part 12*a* is changed by, for example, a revolving driving method that includes a position detection method of the carrying roller 14 (not illustrated) regardless the amount (thickness) of the loaded recording sheet 50*b* such that the biased supply roller 14 is located at the same position.

For example, a position of the supply roller 14 in a case when certain amount of recording sheet 50*b* is loaded as illustrated in FIG. 2 and a position of the supply roller 14 in a case when one sheet of the recording sheet 50*b* is loaded as illustrated in FIG. 3 are the same. As described above, the position of the supply roller 14 is set to be the best position for carrying the recording sheet 50*b* out. Also, pressure force of the supply roller 14 is kept constant regardless the amount of the loaded recording sheet 50*b*.

Note as illustrated in FIG. 4, the supply roller 14, the carrying roller 15, and the separation roller 16 have almost the same widths in respective shaft directions. In the width direction of the recording sheet 50*b* loaded on the loading pallet 12 (which is also the shaft direction of the shaft 35), the supply roller 14, the carrying roller 15, and the separation roller 16 are arranged to be center symmetry with respect to an almost center that is a width center of the recording sheet 50*b*.

Between the supply roller 14 and the carrying roller 15, a friction member 31 in a plane shape is fixed and attached to a carrying guide 32 supported by the printer 1 main body. The friction member 31 is as a second separation part that separates a front end part of the recording sheet 50*b* supplied by the supply roller 14 and guides the front end part to the carrying roller 15. The friction member 31 as a third friction member extends over a width region of the supply roller 14 in the shaft direction of the rotation shaft 35 as illustrated in FIG. 4. A friction surface 31*a* is arranged to be slightly inclined with respect to a traveling direction of the front end part of the recording sheet 50*b* carried out by the supply roller 14 such that the front end part of the recording sheet 50*b* carried out by the supply roller 14 contacts the friction surface 31*a* as illustrated in FIG. 3.

Therefore, the friction member 31 separates the recording sheet 50*b* by giving carrying load to the front end part of the recording sheet 50*b* contacting the friction surface 31*a*, and guides the recording sheet 50*b* to the downstream side. The friction member 31 is formed of a rubber piece made of Ethylene-propylene diene monomer (EPDM) having elasticity.

In a position of a loading surface 12*d* as a medium loading surface in the front end part 12*a* of the loading pallet 12 that contacts the supply roller, a contact part 12*b* as a first friction member is formed. In a position that is on the upper stream side of the contact part 12*b* and doesn't contact the supply roller 14, a high friction member 33 is arranged. An inclined guide part 12*c* is formed that is located next an upperstream side of the high friction member 33, has a rear end that has a step part higher than the high friction member 33, and is inclined from the step part to the upperstream side from the upmost part of the step part to the loading surface 12*d*.

The contact part 12*b* holds the recording sheet 50*b* loaded on the loading pallet 12 with the supply roller 14, and is formed by a molded item, for example, made of a material whose friction coefficient μd with the held recording sheet 50*b* is smaller than an inter-sheet friction coefficient μb of the recording sheet 50*b*. Herein, a molded item that is integrated into the loading pallet 12, which is a molded item (ABS/PC) whose friction coefficient is 0.31, is used for the contact part 12*b*. However, it is not limited to this, as long as having a friction coefficient lower than the inter-sheet friction coefficient of the recording sheet 50*b*, any molded item such as paper piece and felt piece is applicable.

The high friction member 33 arranged in a position that doesn't contact the supply roller 14 is formed of a member whose friction coefficient μc, which is a friction coefficient with contacted recording sheet 50*b*, is higher than the inter-sheet friction coefficient μb. A positional relationship between the high friction member 33 and the supply roller 14 is determined, as described later, from the pressure force of the supply roller 14, the above-described friction coefficient μc of the high friction member 33, and the inter-sheet friction coefficient μb of the passing recording sheet 50*b*. Herein, a material of the high friction member 33 is EPDM whose friction coefficient μc is 0.85; the pressure force of the supply roller 14 is 2.94N (300 gf); a distance "a" from a contact part that the contact part 12*b* contacts the supply roller 14 to the high friction member 33 is 8.0 mm; a height difference amount b from the loading pallet 12 to the high friction member (that corresponds to a thickness of the high friction member 33) is 1.2 mm; and a gap G between the supply roller 14 and the high friction member 33 is 2.2 mm. Therefore, a ridge part 33*a* (see FIG. 2) is formed by a height difference of the height difference amount b in the downstream side end part of the high friction member 33.

In the invention, using the first and second friction members, a sufficient friction force (Fc+Fd) is obtained when plural sheets or envelopes are stacked and these sheets are supplied. On the other hand, when only a single envelope remains on the tray and the final envelope is supplied, a contact between the final envelope and the second friction member is eliminate by the final envelope being curled. Thereby, only a contact between the final envelope and the first friction member remains. In that structure, designing that the friction force Fb generated inside the envelope is less than the friction force Fd with the tray, the top side and bottom side sheets of the envelope can be carried together. For that aim, the second friction force Fc is configured to be greater than the first friction force Fd.

The relationship, Fc>Fd, can be realized to use a material, which has a very high friction coefficient with resect to an envelope, for the second friction member. However, there is no load, which is caused by the supply roller, to be applied to the second friction member. A Friction Force is expressed by a multiple of a load (P) and a friction coefficient (μ). Thereby, even if a material having a very high friction coefficient is used, a sufficient friction force is not necessarily obtained when the load is small. Therefore, in one embodiment of the invention, the second friction member is formed to protrude from the medium loading surface, forming the ridge part 33*a*. An envelope that is loaded and the final one is deformed/curled with the ridge part 33*a*, creating a load to some degree. The curled envelope is expected not to contact the second friction member. A location where the second friction member is arranged is to be in an area where the envelope is curled and not to contact the ridge part 33*a*.

In other words, friction force Fc is generated as second friction force that works as braking force by bending the recording sheet 50*b* in a direction of pressing the recording sheet 50*b* against the high friction member 33 between the recording sheet 50*b* on the bottom and the ridge part 33*a* of the high friction member 33 that contacts the recording sheet 50*b* on the bottom by adjusting the setting positional relationship of the distance "a" and the height difference amount b. For example, by increasing the height difference amount b and decreasing the distance "a", a bending amount of the recording sheet 50*b* is increased and then the friction force Fc is increased. Note, the friction force Fc includes an element generated by the weight of the recording sheet 50*b*.

An adequate ratio of "b/a" is determined by considering materials or weights of sheets etc. In a case where an ordinary envelope, which is made of a common material and has a common size, is used, the following ranges are adequate:

a=10 to 12 (mm)

b=0.5 to 1.5 (mm)

b/a=0.04 to 0.15

It is noted that the curled envelope makes a linear contact, not a plane contact, with the loading surface. Thereby, the load (P) per square, which is caused by the weight of the envelope itself, increases, the friction force (Fc) also increases.

When the envelope is deformed, a returning force is created toward the loading surface. The returning force means a force to release the deformation. Due to the returning force in addition to the force by its weight, the friction force (Fc) increases. Namely, in the embodiment, stiff materials are used for the envelopes, a large amount of friction force (Fc) can be generated.

Note, herein, EPDM whose friction coefficient μc with the recording sheet 50*b* is 0.85 is used for the high friction member 33, however it is not limited to this. Another high friction member such as cork piece and rubber member can be used as long as it has a friction coefficient higher than the inter-sheet friction coefficient μb of the recording sheet 50*b*. The inter-sheet friction coefficient μb of the recording sheet 50*b* varies by type of sheet, but one typical example is approximately 0.35.

As illustrated in FIG. 4, the high friction member 33 and the contact part 12*b* of the loading pallet 12 are preferably configured to have widths wider than the width of the supply roller 14. In this embodiment, the width of the supply roller 14 is set to be 30 mm; the width of the contact part 12*b* is set to be 35 mm; and the width of the high friction member 33 is set to be 35 mm. The supply roller 14 and the carrying roller 15 are rotatably driven in arrow directions by a driving system (not illustrated). The separation roller 16 driven by the carrying roller 15 is held by the torque limiter 40 provided on the same shaft, and generates braking force to brake the contacted recording sheet 50*b*. As a result, it works such that plural sheets of the recording sheet 50*b* are not passed through between the separation roller 16 and the carrying roller 15 at one time.

Herein, the separation roller system using the carrying roller 15 and the separation roller 16 is use as the above-described configuration of the third separation part that brings the separation effect for the recording sheet 50*b*. However, any separation system using the friction separation system such as a separation pad system using a separation pad instead of the separation roller 16 may be used.

With the above-described configuration, a process that the printer 1 prints on the recording sheet 50*b* loaded on the loading pallet 12 is briefly explained.

In the loading pallet 12 on which the recording sheet 50*b* is loaded, a position of the front end part 12*a* is brought upward by a revolving driving method (not illustrated) to a predetermined height position that is suitable for the supply roller 14 biased by the pressure spring 13 to supply the recording sheet 50*b* as illustrated in FIG. 2, which is in other words a height position at which a front part of the recording sheet 50*b* supplied by the supply roller 14 contacts the friction surface of the friction member 31. Then, the supply roller 14 and the carrying roller 15 are rotated in the respective arrow directions (clockwise direction in FIG. 2), and carries a sheet of the recording sheet 50*b* located on the top out to the downstream side.

At this moment, when plural sheets of the recording sheet 50*b* is carried out, due to functions of the friction member 31 as the second separation part and the separation roller 16 as the third separation part, only the sheet of the recording sheet 50*b* located on the top is carried out further to the downstream side and then is reached to the image forming part 6. A sheet supply operation of the sheet supply part 5 is described later in more detail.

After the sheet supply detection sensor 18 detects that the recording sheet 50*b* passes through, the carrying roller pair 19 starts carrying at a predetermined timing, corrects skew of the recording sheet 50*b*, and sends the recording sheet 50*b* out to the image forming part 6. The image forming part 6 starts an electrographic process as synchronizing with a timing when the recording sheet 50 passes through the writing timing sensor 20, forms toner image of the respective colors on the photosensitive drums 21K, 21Y, 21M and 21C, transfers the toner image in an overlapping manner on a recording surface of the recording sheet 50 carried by the transferring belt unit 22, and sends the sheet out to the fuser part 7.

The fuser part 7 fuses the toner image on the recording sheet 50*b* by heat and pressure with the pair of rollers 23 and 24 heated by the heaters 25 and 26. The recording sheet 50*b* on which the image has been fused by the fuser part 7 is detected by the carrying detection sensor 27 to detect if the recording sheet 50*b* has passed through or not, is carried out to the ejection carrying path 8 by the carrying roller pair 28, and is ejected to an outside of the apparatus by the ejection roller pair 29. Then, the printing finishes.

Next, the sheet supply operation of the sheet supply part 5 is explained more. As illustrated in FIG. 2, the recording sheet 50*b* loaded on the loading pallet 12 supported by the medium tray 4 (FIG. 1) is carried out by the supply roller 14. When plural sheets of the recording sheet 50*b* are carried out, front end parts of the plural sheets of the recording sheet 50*b* are bumped into the inclined friction surface 31 a of the friction member 31 as the second separation part, and are separated by friction force of the friction member 31 such that the front end parts shift to get separated along the inclined friction surface 31*a*.

A recording sheet 50*b* that has a high friction between recording sheets and a bad separation property is carried through between the carrying roller 15 and the separation roller 16 in a situation that another recording sheet 50*b* is overlapped and both of the recording sheets 50*b* are not separated from each other on the inclined friction surface of the friction member 31. However, due to the separation effect of the carrying roller 15 and the separation roller 16, which configure the third separation part, both of the recording sheets 50*b* are separated, and only the sheet of the recording sheet 50*b* located on the top is supplied to further downstream.

As a method for preventing plural sheets of the recording sheets 50*b* from being carried in an overlapped manner, the second separation part and the third separation part are provided. In order to enhance the separation property by reducing the burden of separation methods thereof, it is important to enhance a separation effect of a first separation part configured by the supply roller 14 and the high friction member 33 for preventing the plural sheets from being carried in the overlapped manner.

Figure 6:
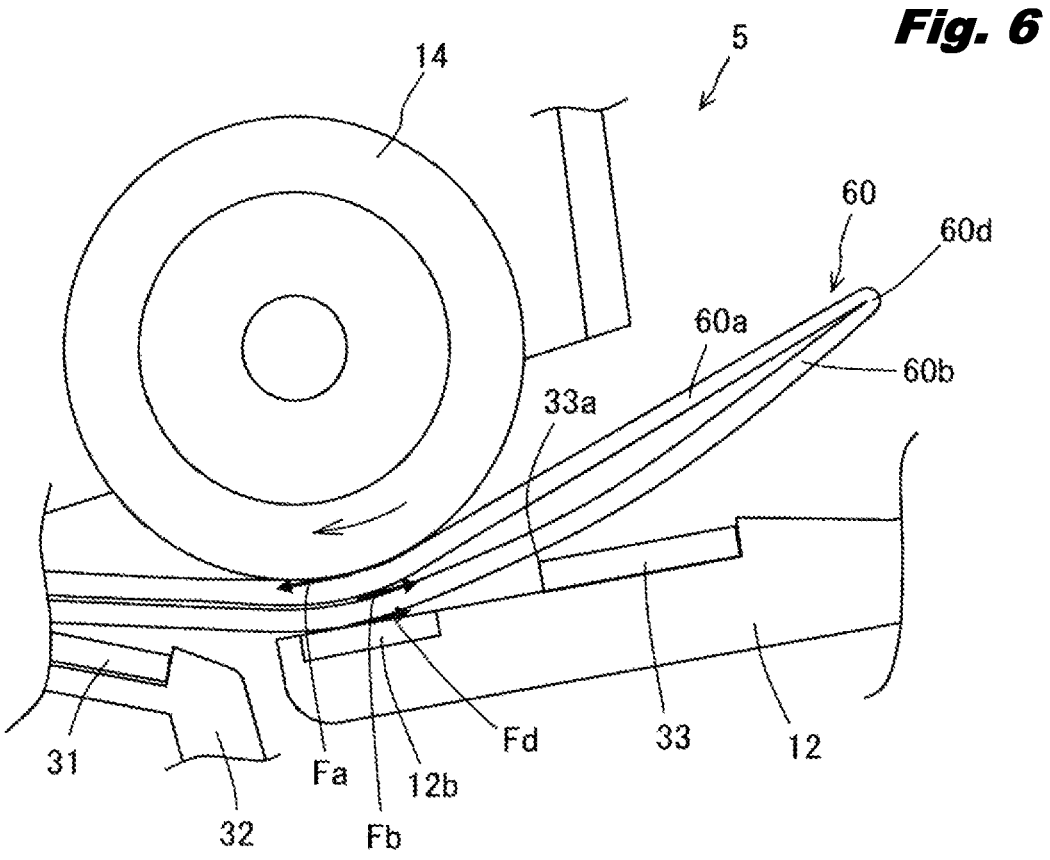
FIG. 6 is a view for explaining a situation that an envelope is supplied in the sheet supply part.

Herein, as illustrated in FIG. 2 and FIG. 6, Fa is assigned to carry-out force of the supply roller 14 that affects on a sheet of the recording sheet 50*b* located on the top; Fb is assigned to friction force between recording sheets; and Fc is assigned to friction force between the high friction member 33 and a sheet of the recording sheet 50*b* located on the bottom, Fd is assigned to friction force as first friction force between the contact part 12*b* and the back-face side sheet 60*b*, and these are set to satisfy a following relationship:

$$Fa>Fc+Fd>Fb \quad (1).$$

Note, when effects of weight of the recording sheet 50*b* is small as being compared to effects of the pressure force (P14) of the supply roller 14 in the friction force Fb and Fc, the friction force Fb is generated based on the pressure force (P14). On the other hand, the friction force Fc is generated based on a force (Pc), which is mainly derived from a deforming force, smaller than the pressure force (P14) of the supply roller 14 because the high friction member 33 is located out of an area sandwiched between the supply roller 14 and the contact part 12*b* and a loaded sheet is deformed by the high friction member 33 creating the deforming force. Therefore, in order to satisfy the relationship (Fc>Fb) of the above-described inequality (1), it is required to suitably set the friction coefficient μc (μc>μb) and the distance "a" and the height difference amount "b" (FIG. 3). In this case, considering the condition where P14>Pc, as long as a condition where the friction coefficient μc is larger than μb is satisfied, the above-described inequality (1) is always satisfied.

The friction forces are explained below:

$$Fc=\mu c\times Pc$$

$$Fb=\mu b\times P14$$

It is noted that the friction coefficient means a coefficient of static friction. When there are more than one envelope on the tray, a large difference between μb and μc is preferred in a view of supplying the envelopes one by one. However, when the final envelope is supplied, the large difference between μb and μc causes the feeding load large. Thereby, the proper difference is determined considering materials or types of envelope to be supplied. The width of the high friction member 33 may be substantially same as a width of the supply roller 14 as illustrated in FIG. 4. The width is defined in a direction that is on the sheet loading surface and perpendicular to the recording medium carrying direction.

As a result, it becomes possible to separate and supply the recording sheet 50*b* one by one from the sheet of the recording sheet 50*b* located on the top to the sheet of the recording sheet 50*b* located on the bottom. The friction force Fb between sheets of the recording sheet 50*b* located in an upper portion is smaller because the effect of the weight of the recording sheet 50*b* affecting on the sheets is smaller, so that this brings a situation that a sheet located on the top is more likely to be separated.

Figure 5:
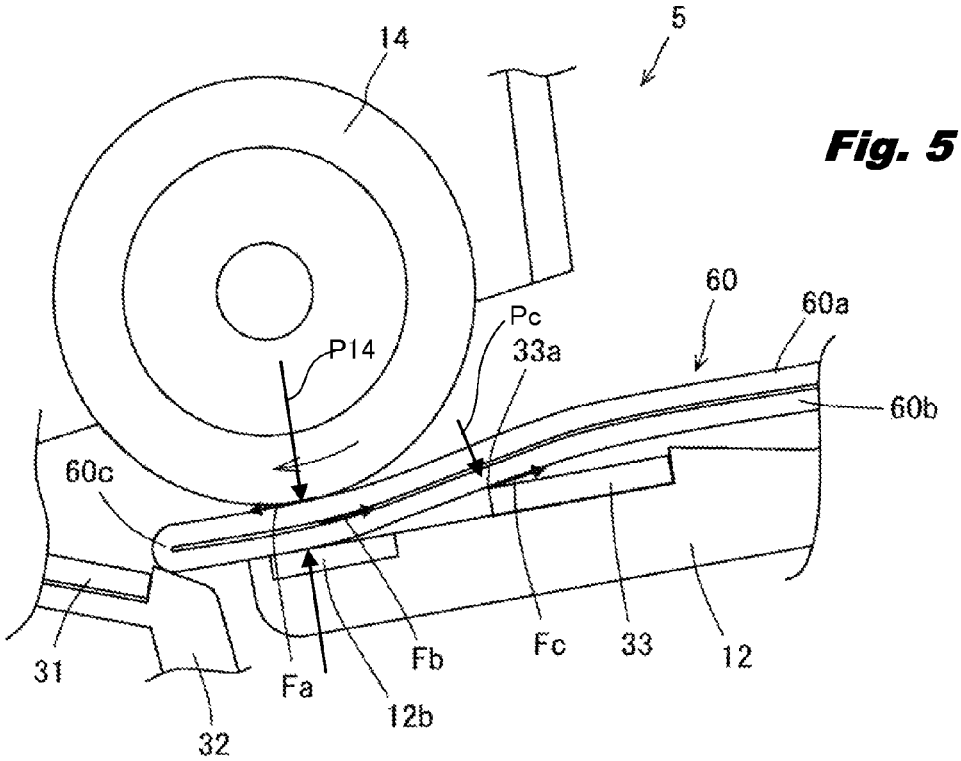
FIG. 5 is a view for explaining a situation that an envelope is supplied in the sheet supply part.

Next, a case that a medium as an envelope 60 illustrated in FIG. 5 that has a pocket-like structure made by two sheets of a surface side sheet 60*a* and a back-face side sheet 60*b* is supplied as a recording medium is explained. FIG. 5 and FIG. 6 are views for explaining a situation that an envelope of the envelope 60 located on the bottom is supplied in the sheet supply part 5.

Herein, the envelope 60 is loaded on the loading surface 12*d* as illustrated in FIG. 5 and FIG. 6 such that the surface side sheet 60*a* faces the supply roller 14, the back-face side sheet 60*b* faces the loading surface 12*d* (FIG. 2) of the loading pallet 12, and both sides parts 60*c* and 60*d* in which the surface side sheet 60*a* and the back-face side sheet 60*b* are connected on both sides are positioned in the recording medium carrying direction.

As illustrated in FIG. 5, when the envelope 60 located on the bottom that has a pocket-like structure made by two sheets of the surface side sheet 60*a* and the back-face side sheet 60*b* is supplied, Fa is assigned to carry-out force of the supply roller 14 that affects on the surface side sheet 60*a*; Fb is assigned to friction force between the surface side and back-face side sheets; Fc is assigned to friction force between the high friction member 33 and the back-face side sheet 60*b;* and Fd is assigned to friction force as first friction force between the contact part 12*b* and the back-face side sheet 60*b,* and these are set to satisfy a following relationship:

$$Fa>Fc>Fb>Fd \quad (2).$$

Note, when effects of weight of the recording sheet 50*b* is small as being compared to effects of the pressure force of the supply roller 14 in the friction force Fb, Fc, and Fd, the friction force Fb and the friction force Fd generated under the same pressure force satisfy the above-described inequality (2) with a relationship of friction coefficients μb and μd (μb>μd). Also as described above, in order that the friction force Fc is generated based on force smaller than the pressure force of the supply roller 14 satisfies the relationship (Fc>Fb) of the above-described inequality (2), it is required to suitably set the friction coefficient μc (μc >μb) and the distance a and the height difference amount b (FIG. 3). In this case, as long as at least the friction coefficient μc is larger than μb, the above-described inequality (2) is always satisfied.

From this, while the surface side sheet 60*a* that contacts the supply roller 14 is supplied, the back-face side sheet 60*b* that contacts the high friction member 33 is braked, so that a carried difference, which is a difference of carried amounts in carrying direction, is generated between the surface side sheet 60*a* and the back-face side sheet 60*b* of one of the envelope 60, the surface side sheet 60*a* receiving a large amount of the separation function generated between the surface side sheet 60*a* and the back-face side sheet 60*b,* the back-face side sheet 60*b* having a small carried amount.

On the other hand, as illustrated in FIG. 3, the distance "a" from the contact part that the contact part 12*b* contacts the supply roller 14 on the loading pallet 12 to the high friction member 33 is 8.0 mm; the height difference amount b of the high friction member 33 is 1.2 mm; and the gap G between the supply roller 14 and the high friction member 33 is 2.2 mm. Therefore, because the surface side sheet 60*a* and the back side sheet 60*b* that configures the envelope 60 are connected at the both sides parts 60*c* and 60*d,* when the carried amount difference occurs between the surface side sheet 60*a* and the back side sheet 60*b,* the envelope 60 distorts in a direction that a part of the envelope 60 located on the upstream side of the supply roller 14 gets distant from the high friction member 33, and then the friction force Fc between the back-face side sheet 60*b* and the high friction member 33 may not be generated.

At this time, friction force generated between the back-face side sheet 60*b* of the envelope 60 and the loading pallet 12 is only the friction force Fd between the back-face side sheet 60*b* and the contact part 12*b* of the loading pallet 12, which is set to be smaller than the friction force Fb between the sheets, and $$Fb>Fd.$$

As a result, the surface side sheet 60*a* and the back side sheet 60*b* are synchronized and carried, and the envelope 60 is supplied to the downstream without increasing the distortion after an initial distortion that occurs just after that sheet is supplied and the back-face side sheet 60*b* of the envelope 60 gets distant from the high friction member 33.

Note, when plural envelopes of the envelope 60 is loaded on the loading pallet 12, a difference of a carried amount is less likely occurs between the surface and back-face sides sheets of the same envelope that are connected in the both sides parts rather than between separated surface and back-face sides sheets of different adjacent envelopes. Therefore, as same as layered recording sheets, envelopes located above an envelope located on the bottom are in a situation that the envelopes are easily separated one by one from the top, so that the envelopes are separated and supplied one by one.

As illustrated above, according to the sheet supply device of the present embodiment, it is possible to perform sheet supply with minimum distortion when loaded envelopes are supplied, so that occurrence of paper jamming and skew during carrying can be suppressed. Also, it is also possible to accurately separate and supply recording sheet one by one when regular recording sheets are loaded.

In the above-described explanation of the embodiment, an electrophotographic printer is used as an example of the image forming apparatus, however, the present invention is applicable also to another apparatus that has a sheet supply device that performs sheet supplying of a medium that has a two-layered structure such as an envelope, such as multifunctional printing device, facsimile, and copier. Also, the image forming method of the image forming part 6 is not specifically limited to the electrographic method, and various methods such as ink jet method are applicable. Furthermore, the present invention is applicable to a manuscript supply device of an image reading device.

In the embodiments, friction forces (more specifically, a dynamic friction force, friction coefficient, magnitude relations among members etc.) between a sheet and friction member 31, between sheet ant contact part 12*b,* between sheet and high friction member 33 are evaluated by, for example, following method.

Figure 7:
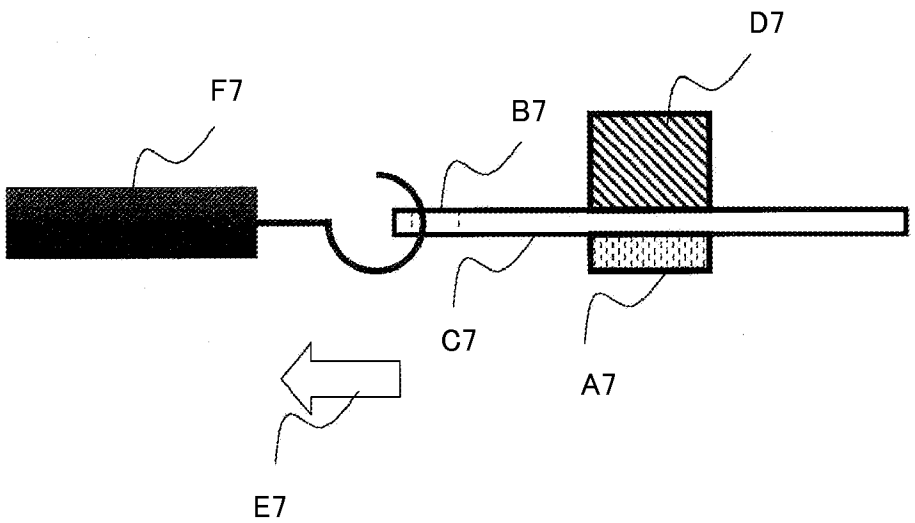
FIG. 7 illustrates an evaluation method for friction force.

See FIG. 7. A test piece A7 is made from each of the members or parts, the piece having the same contact area. Sheet C7 is disposed on test piece A7, sheet C7 having hole B7. Further, weight D7 (200 g in this method) is disposed on Sheet C7. Test piece A7, sheet C7 and weight D7 are arranged in the order from the bottom. Spring scale F7 is connected to sheet C7 through the hock and hole C7. Under the condition, when spring scale 7 is pulled toward the leftward in the drawing, sheet C7 also is dragged with resistance. The amount of the resistance is measured by the scale F7. According to resistances at the moment when the sheet begins to move, friction forces and other characters of the members are determined.

What is claimed is:

1. A sheet supply device, comprising:

a medium loading part that includes a medium loading surface on which medium is loaded; and a medium supply part that is arranged facing the medium surface, and sandwiches the medium with the medium loading part applying a pressure to the medium, and sends the medium loaded in the medium loading part in a predetermined carrying direction, wherein the medium loading part includes a first friction member that is arranged in a position facing the medium supply part so that the first friction member contacts the medium supply part when there is no medium on the medium loading part, and a second friction member that is arranged on an upstream side of the first friction member in the carrying direction and a friction coefficient (μd) between the second friction member and the medium is larger than a friction coefficient (μc) between the first friction member and the medium, and assuming that friction force generated between the medium and the first friction member is first friction force (Fd) and friction force generated between the medium and the second friction member is second friction force (Fc), the second friction force (Fc) is larger than the first friction force (Fd).

2. The sheet supply device according to claim 1, further comprising:

a medium carrying part that is arranged on a downstream side of the medium supply part in the carrying direction; and a third friction member that is arranged between the medium carrying part and the first friction member in the carrying direction, and that is physically separated from the medium carrying part.

3. The sheet supply device according to claim 1, wherein the medium is an envelope formed by a pair of the sheets that are accumulated on the medium loading surface, and both edges of the sheets in the medium carrying direction are connected, and the envelope is arranged such that one of the edges is at the downstream side and the other of the edges is at the upstream side.

4. An image forming apparatus, comprising:

the sheet supply device according to claim 1.

5. The sheet supply device according to claim 1, wherein the second friction member protrudes by a predetermined height (b) in a direction perpendicular to the medium loading surface above the first friction member.

6. The sheet supply device according to claim 5, wherein the loaded medium is configured of plural sheets, and a formula below is satisfied:

$Fa>Fc+Fd>Fb$ where Fa, Fb, Fc and Fd mean friction forces that are generated at the moment that the medium supply part supplies one of the sheets, Fa is generated between the medium supply part and the medium, Fb is generated between the sheets.

7. The sheet supply device according to claim 5, wherein the loaded medium is configured of plural sheets, and inter-sheet friction force (Fb), which is generated between the loaded plural sheets of the medium while one of the sheets is carried, is smaller than the second friction force (Fc).

8. The sheet supply device according to claim 5, wherein the second friction member is arranged with a predetermined distance (a) from the first friction member in the carrying direction, the predetermined distance (a) being determined from a downstream edge of the second friction member to an upstream edge of the first friction member in the carrying direction.

9. The sheet supply device according to claim 8, wherein the second friction member protrudes from the medium loading surface with a predetermined height (b) so that a ridge part is formed on the medium loading surface.

10. The sheet supply device according to claim 9, wherein a ratio of the height (b)/the distance (a) ranges within 0.04 to 0.15.

11. The sheet supply device according to claim 8, wherein the second friction member is arranged at a spot where the second friction member does not contact the medium supply part when there is no medium on the medium loading part.

12. The sheet supply device according to claim 1, wherein the first friction member is embedded in the medium loading part, and an upper surface of the first friction member is flush with the medium loading surface.

13. A sheet supply device, comprising:

a medium loading part that includes a medium loading surface on which medium is loaded; and a medium supply part that is arranged facing the medium loading surface, and sandwiches the medium with the medium loading part applying a pressure to the medium, and sends the medium loaded in the medium loading part in a predetermined carrying direction, wherein the medium loading part includes a first friction member that is arranged in a position facing the medium supply part so that the first friction member contacts the medium supply part when there is no medium on the medium loading part, and a second friction member that is arranged on an upstream side of the first friction member in the carrying direction, a friction coefficient (μd) between the second friction member and the medium is larger than a friction coefficient (μc) between the first friction member and the medium, and the second friction member protrudes by a predetermined height (b) in a direction perpendicular to the medium loading surface above the first friction member.

14. The sheet supply device according to claim 13, further comprising:

a medium carrying part that is arranged on a downstream side of the medium supply part in the carrying direction; and a third friction member that is arranged between the medium carrying part and the first friction member in the carrying direction, and that is physically separated from the medium carrying part.

15. The sheet supply device according to claim 13, wherein the second friction member is arranged with a predetermined distance (a) from the first friction member in the carrying direction, the predetermined distance (a) being determined from a downstream edge of the second friction member to an upstream edge of the first friction member in the carrying direction.

16. The sheet supply device according to claim 15, wherein the second friction member is arranged at a spot where the second friction member does not contact the medium supply part when there is no medium on the medium loading part.

17. The sheet supply device according to claim 13, wherein a ratio of the height (b)/the distance (a) ranges within 0.04 to 0.15.

18. The sheet supply device according to claim 13, wherein the medium that is supplied from the medium supply part is an envelope.

19. An image forming apparatus, comprising:

the sheet supply device according to claim 13.

* * * * *